US005374060A

United States Patent [19]

Goldberg

[11] Patent Number: 5,374,060

[45] Date of Patent: Dec. 20, 1994

[54] METHOD OF WAGERING AT A RACETRACK

[75] Inventor: Nelson L. Goldberg, Pittsburgh, Pa.

[73] Assignee: Total Communication Programs, Inc., Pittsburgh, Pa.

[21] Appl. No.: 80,505

[22] Filed: Jun. 24, 1993

[51] Int. Cl.[5] ..... A63F 3/08

[52] U.S. Cl. ..... 273/139; 273/138 A

[58] Field of Search ..... 273/138 A, 138 R, 139, 273/148 R

[56] References Cited

U.S. PATENT DOCUMENTS

| | | | |
|---|---|---|---|
| 3,762,712 | 10/1973 | Beachley | 273/240 |
| 4,373,726 | 2/1983 | Churchill et al. | 273/138 A |
| 5,043,889 | 8/1991 | Lucey | 364/412 |

OTHER PUBLICATIONS

"5-6 Pool, Pick-Six Bonanza", Scarnes Complete Guide to Gambling by John Scarne, Simon and Schuster, 1961, pp. 89-97.

*Primary Examiner*—Benjamin H. Layno

*Attorney, Agent, or Firm*—Hymen Diamond

[57] ABSTRACT

A method of wagering at a racetrack where the racing entities are typically horses or dogs in whose practice cards are made available to persons attending the races for entering, prior to the beginning of the schedule of races, or, for latecomers, the beginning of a predetermined race herein called the nth race, the identification of the racing entities which each person selects to be "in the money." Cards are available for WIN alone, and/or for WIN and PLACE and/or for WIN, PLACE and SHOW. The payout is on a correct selection of all entities, on all entities less one, on all entities less two, etc., up to for all entities less a predetermined number. The payout is a predetermined prize assigned prior to the start of the races and is commensurate with the probability of the correct selection as the case may be. At racetracks where the entities in each race are numbered sequentially, there are also two types of payoffs. There is a payoff out of the purse wagered to those wagerers whose total selection as equal to actual total which occurred. There is also a payoff independently of the purse wagered to wagerers whose total number of selection is equal to the total of the numbers of the winning entities with the additional condition that the wagerer must have selected correctly for a predetermined number of the races.

10 Claims, 2 Drawing Sheets

METHOD OF WAGERING AT A RACETRACK

BACKGROUND OF THE INVENTION

This invention relates to wagering and it has particular relationship to wagering at racetracks such as horsetracks and dogtracks and racing facilities of other types where there Is wagering. In this application, the racing animal or vehicle will be referred to as a "racing entity" or an "entity." While this invention is described herein as applied specifically to horse or dog races, it is understood that the adaptation of this invention to other activities than horse or dog races, for example, jai alai, auto racing, boat racing and golf, where there is wagering, is within the scope of equivalents thereof. In this application, the word "racetrack" shall be taken to mean any of the facilities mentioned above.

Currently, wagering in a racetrack is confined to wagering on the races one-by-one before each takes place. Wagers can be placed on an entity in each race to win, to place or to show. There is also the daily-double in which there Is a payoff to a wagerer who selects correctly the winning entities in successive races, usually the first and second races, and the Quinella.

It is desirable to enlarge the availability of wagering opportunities and particularly of the opportunities which require skill or knowledge and it is an object of this invention to achieve this purpose.

SUMMARY OF THE INVENTION

This invention arises from the realization that the range of wagering available can be expanded by applying the wagering to the schedule of races as a whole. In accordance with this invention, there is available to the persons attending a racetrack or wagering through an off-track betting establishment or by electronics (herein called "wagerer") the opportunity to select, prior to the start of the schedule of races, the entity which the wagerer predicts will win, and/or place and/or show in each race. There may be a payoff only to the wagerer who selects all of the winning entities in each category of each race. But it is preferred that the payoff shall be to the wagerers who select correctly all of the winning entities in each class, all the winning entities except one, all the winning entities except two, etc., up to all the winning entities up to the nth, where n is an integer in the sequence 1, 2, 3, etc. Typically, n may be three. The payoff may be part of the purse wagered as currently, but preferably it is a prize measured by the probability of occurrence of the criterion for the payoff. Since this probability is usually low, the payoff is a substantial sum. For example, in a track where there are eight scheduled races with eight horses in each race, the probability of a correct selection to win or to place or to show for all races is one divided by 59 billionths ($59\times10^{-9}$). The probability of a correct selection of all but one of the races is one divided by 334 millionths ($334\times10^{-8}$). The probability of a correct selection of all but two of the races is one divided by 82 millionths ($82\times10^{-6}$). The payments can be in the millions for all races of the first category and in the thousands for the others. Insurance against the occurrence of the events is available.

The entities in the races are usually numbered in sequence. There are payoffs in accordance with another aspect of this invention on the total of the numbers of the winning entities in all the races. In this case the amount of the purse available for payment in each category is divided equally among those wagerers the total of the number of whose selection is equal to the total of the numbers of the winning entities in the seven categories. There is also in the practice of this invention another payoff, a high payoff, independently of the purse, which is available for any wagerer whose total of the numbers selected is equal to the total of the winning numbers and, in addition, who has selected correct winning numbers in at least a predetermined number, usually one or two, races.

This invention may be practiced for only one track attended by the wagerer or at off-track betting establishments or the like. It may also be practiced for a number of associated tracks. At each track there may be available facilities to wagerers to elect entities at the other associated tracks. There may be a high payoff for correct selections or totals for all or a number of the associated tracks. The times of the races must be coordinated.

To carry out this invention at a racetrack, the racetrack provides cards with which the wagerers make their selections. Each card has an array of rows of markings, for example, small circles, the number of circles in each row being equal to the number of entities in each corresponding race. In addition, there is a marking, typically a bar code identifying the category, win, place or show or combinations of these categories, covered by the card. The wagerer identifies his selection by filling in or punching out the circle in each row that identifies the selected entities. Before the start of the schedule of races, the wagerer tenders his card or cards at a booth and pays the fee. The attendant at the booth gives the wagerer a ticket showing the category covered by the card, the identifications of the selected entities and where the entities are numbered sequentially, the total of the numbers of the selected entities. The wagerers who win return to a booth for their payoff. A similar or analogous procedure may be followed at an off-track betting establishment or by phone where the wagering is by electronics.

For latecomers, a wagering opportunity starting with a predetermined race is provided. The payoffs are correspondingly adjusted.

A wagerer whose selection in one of the races is scratched after he bought his ticket may receive a refund by presenting his ticket before the race following the race in which his selection was scratched or may retain his ticket for possible payoff on the total. In the case of a scratched race, the payoff is on the remaining races. The racetrack or other betting establishment may enact rules covering this invention.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings; in which.

DETAILED DESCRIPTION OF THE PRACTICE 0F THIS INVENTION AND OF ITS COMPONENTS

Figure 1:
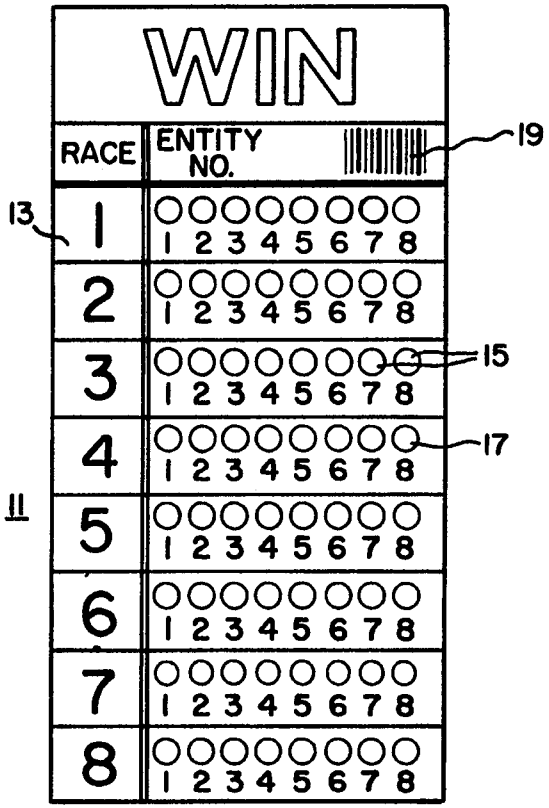
FIGS. 1, 2, 3 and 4 are diagrammatic views showing cards which are made available to wagerers for recording their selections in the practice of the method of this invention.

FIG. 1 shows a card 11 which is made available to the wagerers and who want to make WIN selections. The card 11 is based on the assumption that there are typically eight races with eight entities in each race. The numbers of the races in the order in which they are run is in the left-hand column 13. Opposite each number there is a row 15 of small circles 17 numbered to correspond to the numbering of the racing entities. Above the array of circles there is a bar code 19 which identifies the card as a WIN card.

Figure 2:
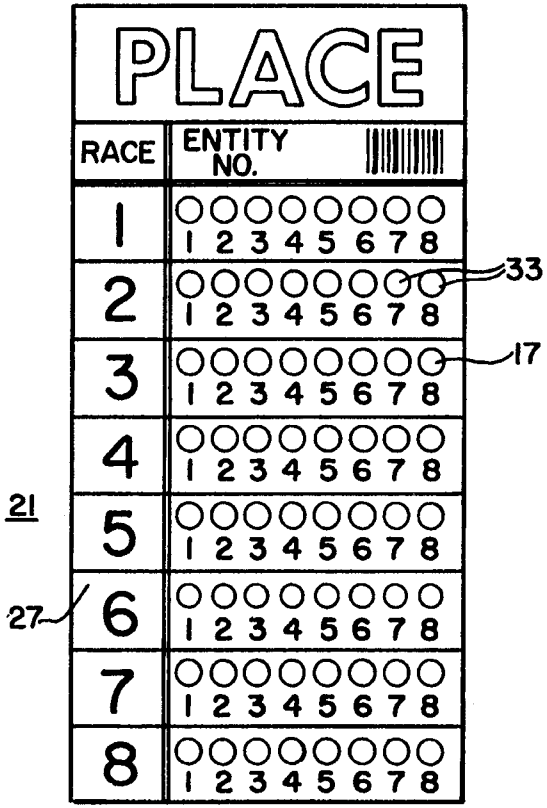
Figure 3:
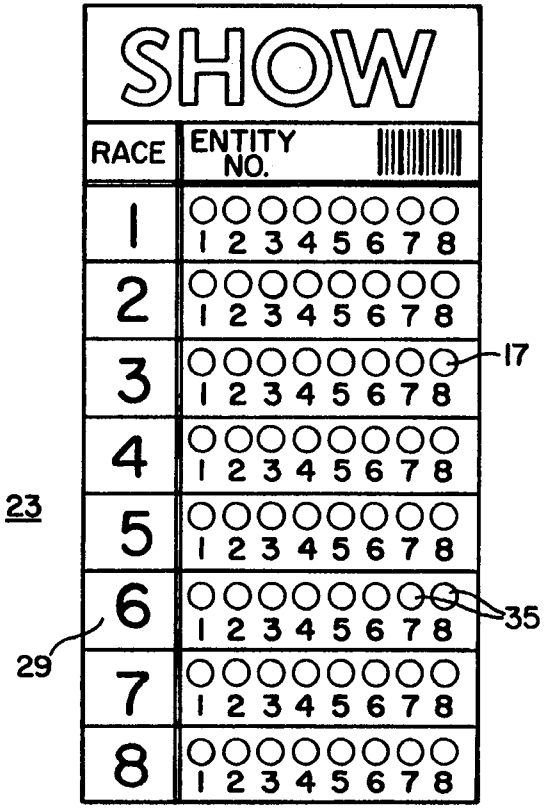
Figure 4:
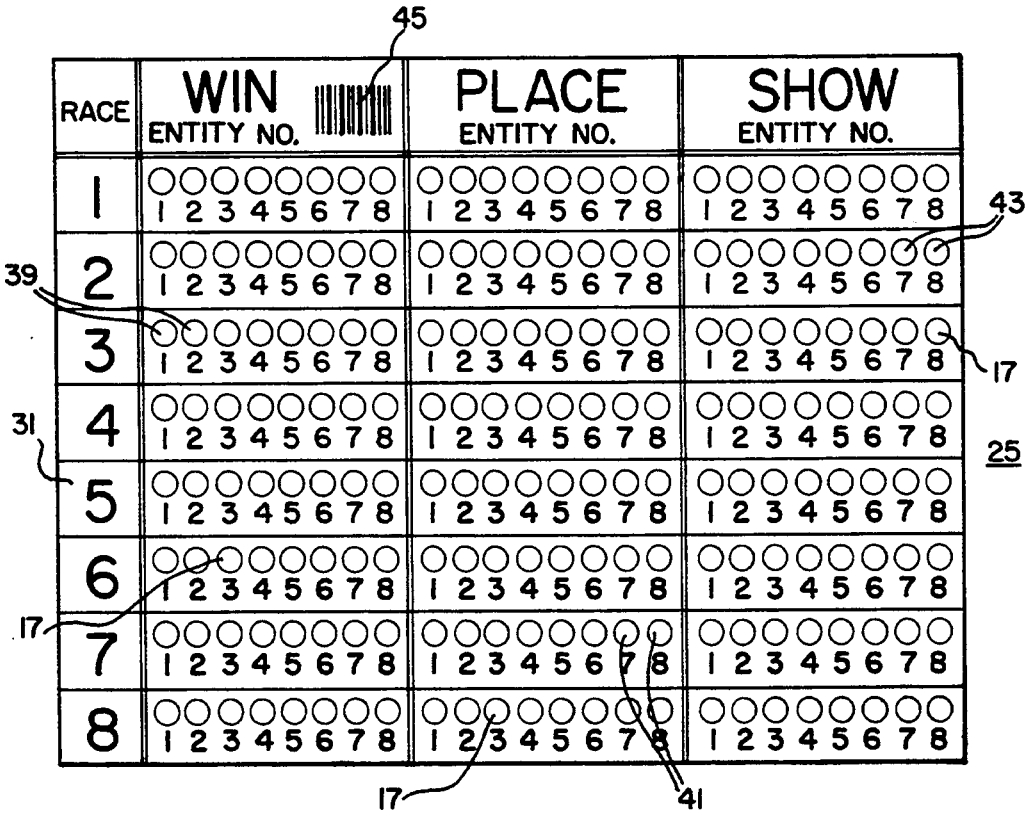

In FIG. 2, a PLACE card 21 is shown for wagerers who want to wager the entities to PLACE. In FIG. 3, a SHOW card 23 is shown for wagerers who want to wager the entities to SHOW. In FIG. 4 a WIN, PLACE and SHOW card 25 is shown for wagerers who want to wager across the board. The cards 21, 23, 25 are similar to the card 11. Each card 21, 23, 25 lists the races in the left-hand column 27, 29, 31 respectively. Each card 21, 23 has a row 33, 35 respectively of small circles opposite to each race number. The card 25 has three sets of rows 39, 41, 43 of small circles numbered to correspond to the numbers of the entities. The card 25 also has an identifying bar code 45.

Figure 5:
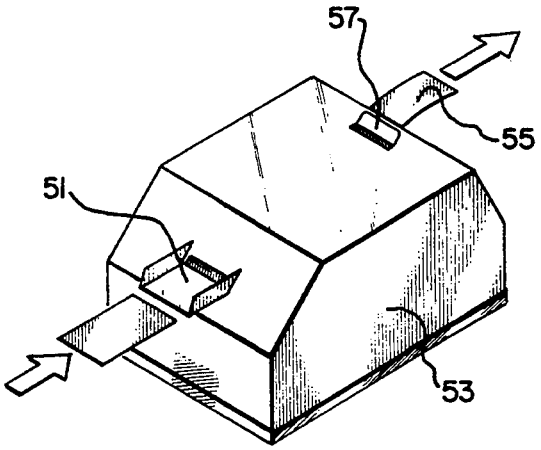
FIG. 5 is a view in isometric showing a register for deriving a ticket based on a selection card in the practice of the method of this invention.
Figure 6:
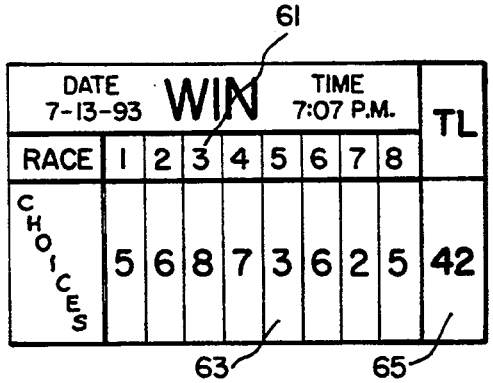
FIG. 6 is a diagrammatic view of a ticket showing the selection of a wagerer in the practice of this invention.

In the practice of this invention, each wagerer fills in a small circle 17 in each of the rows 15, 33, 35, 39, 41, 43 identifying the selected entity. The wagerer then gives the card to an attendant at a booth who inserts the card in a slot 51 in a computerized register 53 (FIG. 5). The register 53 ejects a ticket 55 at its outlet 57. A ticket 55 for WIN is shown in FIG. 6.

The ticket is ruled in spaces 61, 63, a square space 61 above and a rectangular space 63 aligned with the corresponding square space below. The race number is entered in the square space 61 and the corresponding entity selected is entered in the aligned rectangular space 63 below. There is also a rectangular space 65 for entering the total. Successful wagerers are paid off at booths in the usual manner. The ticket shows the time and date of the selection.

While preferred practice and preferred embodiments of this invention have been disclosed herein, many modifications are feasible. For example, this invention in its broader aspects may be adapted to golf. Wagerers may select before the start of a tournament the number of strokes of the winner or the number of strokes of the winner and those second and third or any number below the winner. The payoff in this case would be a fraction of the purse. Wagerers may also wager on the totals of a number of tournaments which takes place during a week or which takes place over several weeks. In the same way this invention may be adapted to other sports events. This invention is not to be restricted except insofar as is necessitated by the spirit of the prior art.

I claim:

1. The method of wagering on the schedule of races as a whole at a racetrack, comprising:

(a) Making available to wagerers means for entering for all races, prior to the beginning of the scheduled races, the identifications of the racing entities in each race which each said wagerer selects to win and/or to place and/or to show;

(b) Assigning a predetermined prize to each of said win and/or place and/or show categories prior to the start of all the scheduled races;

(c) On tendering by said each wagerer, prior to the start of the schedule of races, his entering means with his selections entered therein, giving said each wagerer a ticket showing his selections; and (d) On the surrender of said ticket, following the completion of the schedule of races, by each wagerer who has made correct selections for a predetermined number of races, paying said last-named wagerer a predetermined prize, the said method being characterized by that the predetermined prize is independent of the total pool wagered by all wagerers on the category selected of the schedule of races but is of an order higher than said pool commensurate with the mathematical probability of the making of a correct selection by a wagerer in the entering means.

2. The method of claim 1 wherein there is payment only for correct selection for all of the scheduled races.

3. The method of claim 1 wherein there are separate graduated payments for correct selection for all races, for all races less than 1, for all races less than 2, and so on up to for all races less than n where n is a number in the sequence 1, 2 . . . n.

4. The method of wagering at a racetrack wherein the racing entities are identified by numbers; comprising:

(a) Making available to each wagerer, prior to the scheduled races, means for entering for all races the numbers identifying the racing entities in each race which each said wagerer selects to win and/or to place and/or to show;

(b) On tendering by said each wagerer, prior to the beginning of the schedule of races, of his entering means with his said selections entered therein, giving said each said wagerer a ticket showing his selections;

(c) Adding the said identifying numbers of the racing entities which said wagerer has selected to win and/or to place and/or to show for all races to compute a total of the numbers identifying the selected entities; and (d) On surrendering by a wagerer of a ticket showing said total equal to the totality of the numbers of entities winning and/or placing and/or showing in the races, paying said last-named wagerer a predetermined payoff.

5. The method of claim 4 wherein only a ticket predetermined of whose numbers shall identify entities which actually won, and/or placed and/or showed as the case may be shall be entitled to the predetermined payoff.

6. The method of claim 4 wherein the payoff is paid out of the purse wagered, the amount available from the purse being divided equally among the successful wagers.

7. The method of claim 4 wherein the payoff to successful wagerers is independent of the purse wagered but there is payoff only to wagerers who, in addition to having selected the correct total of the numbers identifying the winning identities, has also selected the correct winning entities in a predetermined number of races.

8. The method of claim 7 characterized by that the payoff is commensurate with the mathematical probability of selection by a wagerer of correct winning entities in the predetermined number of the races.

9. A method of wagering on the scheduled races as a whole for the wagerers attending a racetrack; comprising:

(a) Making available to said wagerers means for entering for all races starting with a predetermined race (herein called the nth race) of the schedule races, prior to the start of the nth race, the identifications of the racing entities in each race starting with the nth race which each said wagerer selects to win and/or to place and/or to show;

(b) Assigning predetermined prize to each of said win and/or to place and/or to show categories prior to the start of the nth race of said schedule of races;

(c) On tendering, prior to the start of the nth race, by said each of said wagerers of his entering means with his selection entered therein, giving said each of said wagerers a ticket showing his selection; and (d) On surrendering by a said wagerer of a ticket showing correct selections for a predetermined number of races of the schedule of races beginning with the nth race, paying said wagerer a predetermined prize; the said method being characterized by that said predetermined prize is independent of the pool wagered by all wagerers on the selected category of the schedule of races but is of an order higher than said pool commensurate with the mathematical probability of the making of a correct selection by a wagerer on the entering means.

10. The method of wagering on the schedule of races as a whole at a racetrack, comprising:

(a) Making available to wagerers means for entering for all races, prior to the beginning of the scheduled races, the indentifications of the racing entities in each race which each said wagerer selects to win and/or to place and/or to show;

(b) Assigning a predetermined prize to each of said win and/or to place and/or to show categories prior to the start of all the schedule of races;

(c) Prior to the start of said schedule of races, responsive to the selections entered by each said wagerer, entering an identification of the selections of each said wagerer in each category; and (d) Following the completion of the schedule of races, paying said last-named wagerer said predetermined prize for the correct selection for a predetermined number of races; the said method being characterized by that said predetermined prize for any category shall be independent of the pool wagered by all wagerers but shall be of an order higher than the pool commensurate with the mathematical probability of a correct selection for said predetermined number of races.

* * * * *